US010373561B2

(12) United States Patent
Wu et al.

(10) Patent No.: US 10,373,561 B2
(45) Date of Patent: Aug. 6, 2019

(54) PIXEL CIRCUIT AND DRIVING METHOD THEREOF, DISPLAY PANEL AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu (CN)

(72) Inventors: Yuan Wu, Beijing (CN); Luxia Jiang, Beijing (CN); Jianjun Li, Beijing (CN); Jun Nie, Beijing (CN); Zheng Wang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu (CN)

( * ) Notice: Subject to any disclaimer, the term of this patent is extended or adjusted under 35 U.S.C. 154(b) by 211 days.

(21) Appl. No.: 15/325,756

(22) PCT Filed: Jul. 7, 2016

(86) PCT No.: PCT/CN2016/089070
§ 371 (c)(1),
(2) Date: Jan. 12, 2017

(87) PCT Pub. No.: WO2017/117952
PCT Pub. Date: Jul. 13, 2017

(65) Prior Publication Data

US 2018/0226025 A1 Aug. 9, 2018

(30) Foreign Application Priority Data

Jan. 4, 2016 (CN) ..... 2016 1 0003811

(51) Int. Cl.
*G09G 3/32* (2016.01)
*G09G 3/3233* (2016.01)
(Continued)

(52) U.S. Cl.
CPC ..... *G09G 3/3258* (2013.01); *G09G 3/3233* (2013.01); *G09G 3/3283* (2013.01);
(Continued)

(58) Field of Classification Search
None
See application file for complete search history.

(56) References Cited

U.S. PATENT DOCUMENTS

2008/0169754 A1 7/2008 Yang et al.
2010/0164847 A1* 7/2010 Lee ..... G09G 3/3233 345/77

(Continued)

FOREIGN PATENT DOCUMENTS

CN 1874627 A 12/2006
CN 102314829 A 1/2012

(Continued)

OTHER PUBLICATIONS

China First Office Action, Application No. 201610003811.6, dated Nov. 4, 2016, 14 pps.: with English Translation.

(Continued)

*Primary Examiner* — Chad M Dicke
(74) *Attorney, Agent, or Firm* — Armstrong Teasdale LLP

(57) ABSTRACT

The present disclosure provides a pixel circuit including a reset module, a storage module, a data write module, a drive module, a control voltage compensation module, a light emission control module, and a light emitting module. The reset module is connected to a third power source, a second scan line, and the storage module, and is configured to reset the voltage stored in the storage module. The storage module (Continued)

is connected to a first power source and is configured to store a control voltage for the drive module. The data write module is connected to a data line and a third scan line, and is configured to provide a voltage required for the display of the pixel circuit to the drive module.

14 Claims, 10 Drawing Sheets

(51) Int. Cl.
*G09G 3/3258* (2016.01)
*G09G 3/3283* (2016.01)
*G09G 3/3291* (2016.01)

(52) U.S. Cl.
CPC ... *G09G 3/3291* (2013.01); *G09G 2300/0814* (2013.01); *G09G 2300/0819* (2013.01); *G09G 2310/0251* (2013.01); *G09G 2320/0238* (2013.01)

(56) References Cited

U.S. PATENT DOCUMENTS

2012/0001893 A1* 1/2012 Jeong ..... G09G 3/3233 345/213
2012/0038683 A1* 2/2012 Park ..... G09G 3/3233 345/690
2013/0038589 A1* 2/2013 Tseng ..... G09G 3/3233 345/211

FOREIGN PATENT DOCUMENTS

| | | | |
|---|---|---|---|
| CN | 102346999 | A | 2/2012 |
| CN | 103956140 | A | 7/2014 |
| CN | 104867442 | A | 8/2015 |
| CN | 105427807 | A | 3/2016 |
| KR | 2007019463 | A | 2/2007 |
| KR | 2008054764 | A | 6/2008 |

OTHER PUBLICATIONS

China Second Office Action, Application No. 201610003811.6, dated Mar. 15, 2017, 16 pps.: with English Translation.
PCT (CN) International Search Report, Application No. PCT/CN2016/089070, dated Sep. 22, 2016, 8 pps.
PCT (CN) International Written Opinion, Application No. PCT/CN2016/089070, dated Sep. 22, 2016, 10 pps.: with English Translation.

* cited by examiner

PIXEL CIRCUIT AND DRIVING METHOD THEREOF, DISPLAY PANEL AND DISPLAY DEVICE

CROSS REFERENCE TO RELATED APPLICATIONS

This application is a National Stage entry of PCT/CN2016/089070 filed Jul. 7, 2016, which claims the benefit and priority of Chinese Patent Application No. 201610003811.6, filed on Jan. 4, 2016, the entire contents of which are both incorporated by reference herein in their entirety as part of the present application.

BACKGROUND

The present disclosure relates to the field of tablet display technology, and particularly, to a pixel circuit and a driving method thereof, a display panel and a display device.

Organic Light Emitting Diode (OLED) display technology is an important development direction in current display technologies. The OLED display technology uses self-luminous organic light emitting diodes (OLEDs) to display images without the use of backlight elements. Compared with the Liquid Crystal Display (LCD) including the liquid crystal structure and the backlight element, it has the advantages of simple structure, thin thickness, and fast response. It is possible to satisfy the user's demand for a lighter, thinner, and more convenient display.

In the OLED display technology, the Active Matrix Organic Light Emitting Diode (AMOLED) technology and the Passive Matrix Organic Light Emitting Diode (PMOLED) technology are included according to the driving mode. PMOLED simply forms a matrix shape with cathode and anode, and lights up pixels in the array in a scanning way, and each pixel operates in a short pulse mode and emits light for instant high luminance. Its advantage is in the simple structure, which can effectively reduce the manufacturing cost. A potential problem is that the high drive voltage renders PMOLED not suitable for large-size and high-resolution panels. AMOLED technology uses a separate thin film transistor to control each pixel, which can be driven continuously and independently to emit light and can be driven using a low-temperature polysilicon or oxide TFT, and has advantages of low drive voltage and long life of the light emitting components. As a result, AMOLED technology has become the focus of the next generation of display technology.

FIG. 1 is a circuit diagram of an AMOLED pixel circuit disclosed in the prior art. As shown in FIG. 1, the pixel circuit uses drain current compensation transistors (a first transistor T1 and a seventh transistor T7) and threshold voltage compensation transistors (a fourth transistor T4 and an eighth transistor T8) to improve the flicker characteristics of the pixels and display an image with low flicker image quality.

However, the circuit in the prior art is still insufficient for the control precision of the OLED. As shown in FIG. 1, in the phase of writing data, the current flows from the drain to the source of the third transistor T3. In the light emission phase, the current flows from the source to the drain of the third transistor T3. Although the third transistor T3 has a symmetrical structure, the source and the drain can be exchanged for use. However, there is a slight difference between the drain-source voltage drop and the source-drain voltage drop of the third transistor T3, which will directly affect the control precision of the OLED and thus affect the precision of the OLED light emission. In addition, the circuit structure shown in FIG. 1 cannot eliminate the leakage current passing through the OLED outside the light emitting period, i.e., cannot eliminate the slight light emitting phenomenon caused by the leakage current.

BRIEF DESCRIPTION

Embodiments of the present disclosure provide a pixel circuit and a driving method thereof, a display panel and a display, so that the current flows through the drive module in the same direction in data writing and in light emission, improving the control precision of the organic light emitting diode OLED and solving the slight light emitting phenomenon caused by OLED leakage current.

According to a first aspect, the present disclosure provides a pixel circuit including a reset module, a storage module, a data write module, a drive module, a control voltage compensation module, a light emission control module, and a light emitting module. The reset module is connected to a third power source, a second scan line and the storage module, and configured to reset the voltage stored in the storage module. The storage module is connected to a first power source, and configured to store a control voltage for the drive module. The data write module is connected to a data line and a third scan line, and configured to supply a voltage required for the display of the pixel circuit to the drive module. The drive module is connected to the storage module, and configured to drive the light emitting module to emit light via the light emission control module, based on the control voltage stored in the storage module. The control voltage compensation module is connected to the third scan line and the drive module, and configured to compensate the voltage provided by the data write module to obtain the control voltage for the drive module. The light emission control module is connected to a first scan line and the first power source, and configured to control the provision of the voltage of the first power source to the drive module and control the driving of the drive module to the light emitting module. The light emitting module is configured to emit light, under the driving of the drive module.

In embodiments of the present disclosure, the drive module includes a control electrode, a first electrode, and a second electrode. The control electrode of the drive module is connected to the storage module. The first electrode of the drive module is connected to the data write module, and to the first power source via the light emission control module. The second electrode of the drive module is connected to the light emitting module via the light emission control module. The control voltage compensation module is connected to the control electrode and second electrode of the drive module.

In embodiments of the present disclosure, the drive module includes a second transistor. A control electrode, a first electrode, and a second electrode of the second transistor are connected to the control electrode, the first electrode and the second electrode of the drive module, respectively.

In embodiments of the present disclosure, the pixel circuit further includes a shunt module, the shunt module connected in parallel to the light emitting module, and configured to shunt the current flowing through the light emitting module.

In embodiments of the present disclosure, the shunt module includes a seventh transistor. A first electrode and a second electrode of the seventh transistor are connected to the light emitting module, and a control electrode of the seventh transistor is connected to the first scan line.

In embodiments of the present disclosure, the reset module, the data write module, the control voltage compensation module, and the light emission control module are implemented with transistors. In the pixel circuit, the seventh transistor is an N-type MOS transistor, and the remaining transistors are P-type MOS transistors.

According to a second aspect, the present disclosure provides a method for driving the pixel circuit, including a first phase, a second phase, a third phase, a fourth phase, and a fifth phase. In the first phase, the light emitting module is initialized. In the second phase, a voltage stored in the storage module is reset to be the voltage of the third power source. In the third phase, a control voltage for the drive module is stored in the storage module. In the fourth phase, the light emitting module is reset. In the fifth phase, the light emitting module is driven to emit light by the drive module based on the voltage stored in the storage module.

In embodiments of the present disclosure, the pixel circuit further includes a shunt module, connected in parallel to the light emitting module, and configured to shunt the current flowing through the light emitting module. The method also includes, in the first to fourth phases, shunting the current flowing through the organic light emitting diode, by the shunt module.

In embodiments of the present disclosure, the shunt module includes a seventh transistor. A first electrode and a second electrode of the seventh transistor are connected to the light emitting module. The method further includes turning on the seventh transistor in the first to fourth phases. In the fifth phase, the seventh transistor is turned off.

In embodiments of the present disclosure, the drive module, the reset module, the data write module, the control voltage compensation module, and the light emission control module are implemented with transistors. In the first phase, the data write module is turned off, the driver module is turned off, the control voltage compensation module is turned off, the light emission control module is turned off, and the reset module is turned off. In the second phase, the data write module is turned off, the drive module is turned on, the control voltage compensation module is turned off, the light emission control module is turned off and the reset module is turned on. In the third phase, the data write module is turned on, the drive module is turned on, the control voltage compensation module is turned on, the light emission control module is turned off, and the reset module is turned off. In the fourth phase, the data write module is turned off, the drive module is turned off, the control voltage compensation module is turned off, the light emission control module is turned off, and the reset module is turned off. In the fifth phase, the data write module is turned off, the drive module is turned on, the control voltage compensation module is turned off, the light emission control module is turned on, and the reset module is turned off.

In embodiments of the present disclosure, in the pixel circuit, the seventh transistor is an N-type MOS transistor, and the remaining transistors are P-type MOS transistors. The method further includes, in a first phase, providing a high level voltage on the first scan line, providing a high level voltage on the second scan line, providing a high level voltage on the third scan line, and providing a low level voltage on the data line. In the second phase, a high level voltage is provided on the first scan line, a low level voltage is provided on the second scan line, a high level voltage is provided on the third scan line, and a low level voltage is provided on the data line. In the third phase, a high level voltage is provided on the first scan line, a high level voltage is provided on the second scan line, a low level voltage is provided on the third scan line, and a high level voltage is provided on the data line. In the fourth phase, a high level voltage is provided on the first scan line, a high level voltage is provided on the second scan line, a high level voltage is provided on the third scan line, and a low level voltage is provided on the data line. In the fifth phase, a low level voltage is provided on the first scan line, a high level voltage is provided on the second scan line, a high level voltage is provided on the third scan line, and a low level voltage is provided on the data line.

According to a third aspect, the present disclosure provides a display panel including a pixel circuit of any of the above.

According to a fourth aspect, the present disclosure provides a display device including the above-described display panel.

According to embodiments of the present disclosure, the wiring mode of the driving circuit is changed to optimize the current collecting manner of the capacitor C so that the current flows through the second transistor T2 in different phases always in the same direction, greatly improving uniformity and accuracy of turning on the second transistor T2. The overall contrast of the display panel can also be increased due to more precise control of each pixel. Also, the change in the wiring mode reduces the space required for the display panel layout, which is advantageous for the improvement in the resolution. In addition, the seventh transistor T7 connected to the organic light emitting diode OLED is added, to shunt the organic light emitting diode OLED out of the light emitting phase, eliminating the slight light emitting phenomenon caused by the leakage current. In the case of a black picture, a low luminance can be ensured. In the case of not affecting white picture, the contrast can be improved.

BRIEF DESCRIPTION OF THE DRAWINGS

In order to more clearly illustrate the technical solution in the embodiments of the present disclosure, the drawings in the embodiments will be briefly described below. It should be understood that the drawings described below relate only to some embodiments of the present disclosure, instead of limiting the present disclosure, in which.

DETAILED DESCRIPTION

In order that the technical solutions and advantages of the embodiments of the present disclosure will become more apparent, the technical solutions of the embodiments of the present disclosure will be clearly and completely described below with reference to the accompanying drawings. Obviously, the described embodiments are a part of the embodiments of the present disclosure, but not all embodiments. Based on the described embodiments of the present disclosure, all other embodiments obtained by those skilled in the art without the need for creative work fall within the scope of the present disclosure.

Figure 1:
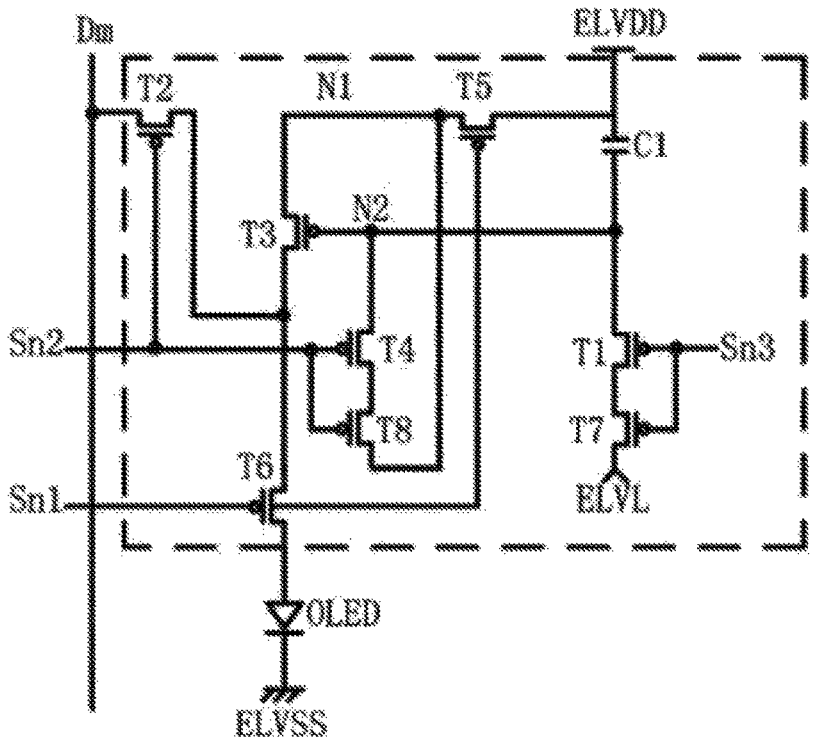
Figure 1 (PRIOR ART)
FIG. 1 is a circuit diagram of a prior art AMOLED pixel circuit.
Figure 2:
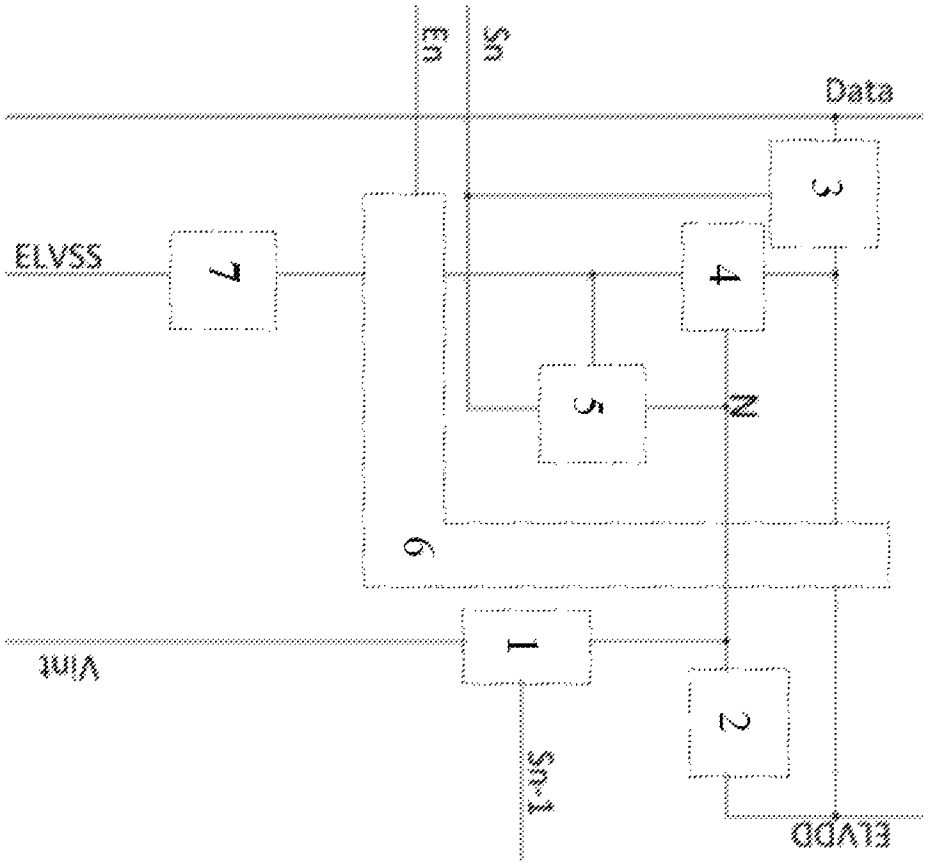
FIG. 2 is a block diagram of a pixel circuit according to one embodiment of the present disclosure.

FIG. 2 is a block diagram of a pixel circuit according to one embodiment of the present disclosure. As shown in FIG. 2, the pixel circuit of the present embodiment is supplied with power from a first power source ELVDD, a second power source ELVSS, and a third power source Vint, and is inputted with a signal for controlling whether or not the pixel circuit emits light from a first scan line En, a reset signal for resetting the pixel circuit from a second scan line Sn-1, a signal for writing display data to the pixel circuit from a third scan line Sn, and a signal corresponding to the display data of the pixel circuit from the data line Data.

The pixel circuit of the present embodiment may include a reset module 1, a storage module 2, a data write module 3, a drive module 4, a control voltage compensation module 5, a light emission control module 6, and a light emitting module 7. The reset module is connected to the third power source Vint, the second scan line Sn-1, and the storage module 2. The reset module 1 is controlled by a signal inputted from the second scan line Sn-1 for resetting the voltage stored in the storage module 2. The storage module 2 is connected to the first power source ELVDD and the drive module 4, for storing a control voltage for the drive module 4. The data write module is connected to the data line Data and the third scan line Sn, is connected to the storage module 2 via the drive module 4 and the control voltage compensation module 5, and is controlled by a signal inputted from the third scan line Sn, for providing the voltage required for displaying the pixel circuit to the drive module. The drive module 4 is connected to the light emission control module 6 and the storage module 2, for driving the light emitting module 7 to emit light via the light emission control module 6 according to the control voltage stored in the storage module 2. The control voltage compensation module 5 is connected to the third scan line Sn, the drive module 4 and the storage module 2, controlled by the signal inputted from the third scan line Sn, for compensating the voltage provided by the data write module 3 to obtain the control voltage for the drive module 4. The light emission control module 6 is connected to the first scan line En, the first power source ELVDD, the drive module 4, and the light emitting module 7, for controlling the connection between the drive module 4 and the first power source ELVDD and the connection between the drive module 4 and the light emitting module 7, based on the voltage inputted from the first scan line En, i.e., controlling the provision of the voltage of the first power source ELVDD to the drive module 4 and controlling the driving of the drive module 4 to the light emitting module 7. The light emitting module 7 is configured to emit light, under the driving of the drive module 4.

The drive module 4 includes a control electrode, a first electrode and a second electrode. The control electrode of the drive module 4 is connected to the storage module 2. The first electrode of the drive module 4 is connected to the data write module 3, and is connected to the first power source ELVDD via the light emission control module 6. The second electrode of the drive module 4 is connected to the light emitting module 7 via the light emission control module 6. The control voltage compensation module 5 is connected to the control electrode and the second electrode of the drive module 4. In this way, it may make the current flow through the drive module in different phases in the same direction.

Figure 3:
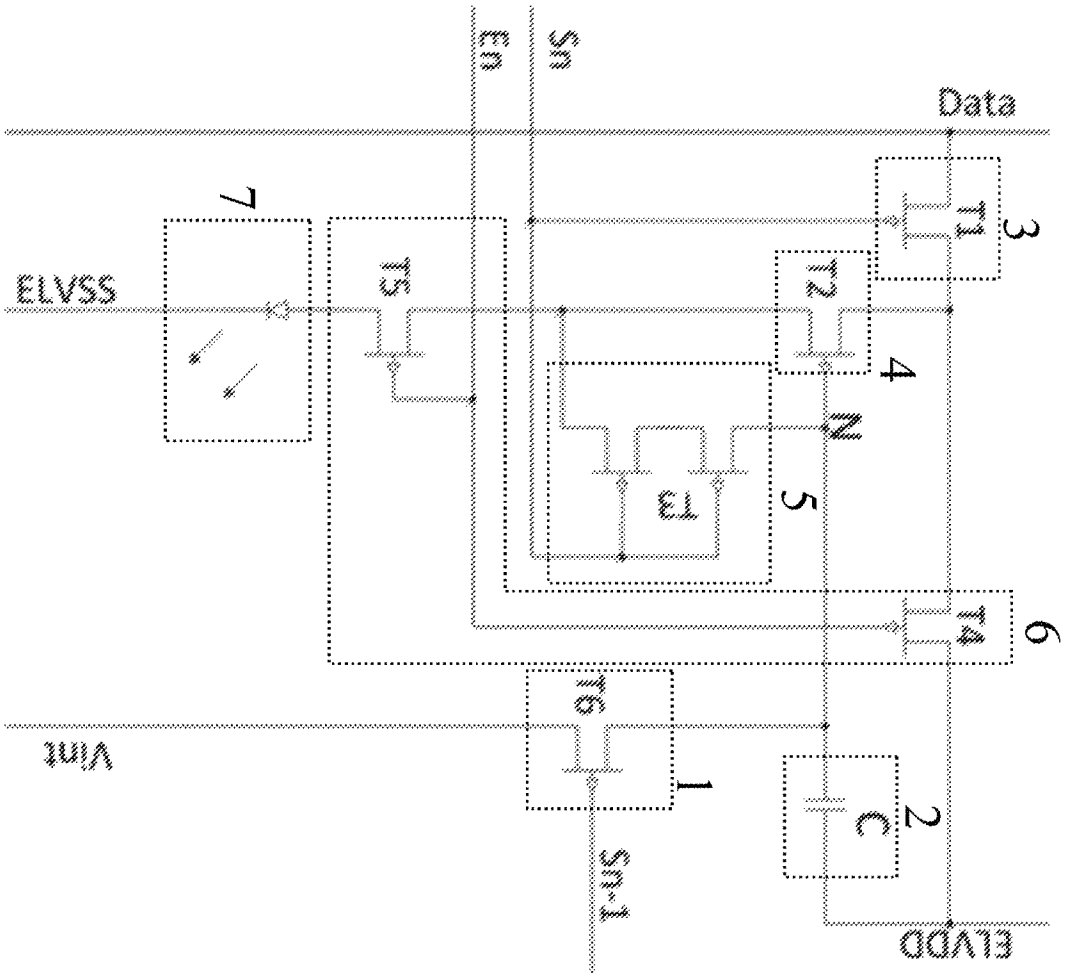
FIG. 3 is a circuit diagram of the pixel circuit of the embodiment shown in FIG. 2.

FIG. 3 is a circuit diagram of the pixel circuit of the embodiment shown in FIG. 2. As shown in FIG. 3, the drive module 4 includes a second transistor T2, and the control electrode of the second transistor T2 is connected to the storage module 2. The first electrode of the second transistor T2 is connected to the data write module 3, and the first electrode of the second transistor T2 is connected to the first power source ELVDD via the light emission control module 6. The control voltage compensation module 5 is connected between the second electrode and the control electrode of the second transistor T2, and the second electrode of the second transistor T2 is connected to the light emitting module 7 via the light emission control module 6.

The reset module 1 includes a sixth transistor T6. The storage module 2 includes a capacitor C. The data write module 3 includes a first transistor T1. The control voltage compensation module 5 includes a third transistor T3. The light emission control module 6 includes a fourth transistor T4 and a fifth transistor T5. The light emitting module 7 includes an organic light emitting diode OLED. The control electrode of the first transistor T1 is connected to the third scan line Sn, the first electrode of the first transistor T1 is connected to the data line Data, and the second electrode of the first transistor T1 is connected to the first electrode of the second transistor T2. The control electrode of the second transistor T2 is connected to the first electrode of the third transistor T3, and the second electrode of the second transistor T2 is connected to the second electrode of the third transistor T3. The control electrode of the third transistor T3 is connected to the third scan line Sn. The control electrode of the fourth transistor T4 is connected to the first scan line En, the first electrode of the fourth transistor T4 is connected to the first power source ELVDD, and the second electrode of the fourth transistor T4 is connected to the second electrode of the first transistor T1. The control electrode of the fifth transistor T5 is connected to the first scan line En, the first electrode of the fifth transistor T5 is connected to the second electrode of the second transistor T2, and the second electrode of the fifth transistor T5 is connected to the first electrode of the organic light emitting diode OLED. The control electrode of the sixth transistor T6 is connected to the second scan line Sn-1, and the second electrode of the sixth transistor T6 is connected to the third power source Vint. The capacitor C is connected between the first power source ELVDD and the first electrode of the sixth transistor T6.

As shown in FIG. 3, for the control voltage compensation module 5, it may use two transistors in series instead of one transistor. The second electrode of one transistor is connected to the first electrode of the other transistor, and the control electrodes of the two transistors are connected to each other, then they are used for external wiring. In addition, for the reset module 1, one or two transistors may be used. That is, those skilled in the art can adjust the number of transistors according to the specific circuit requirements.

Figure 4:
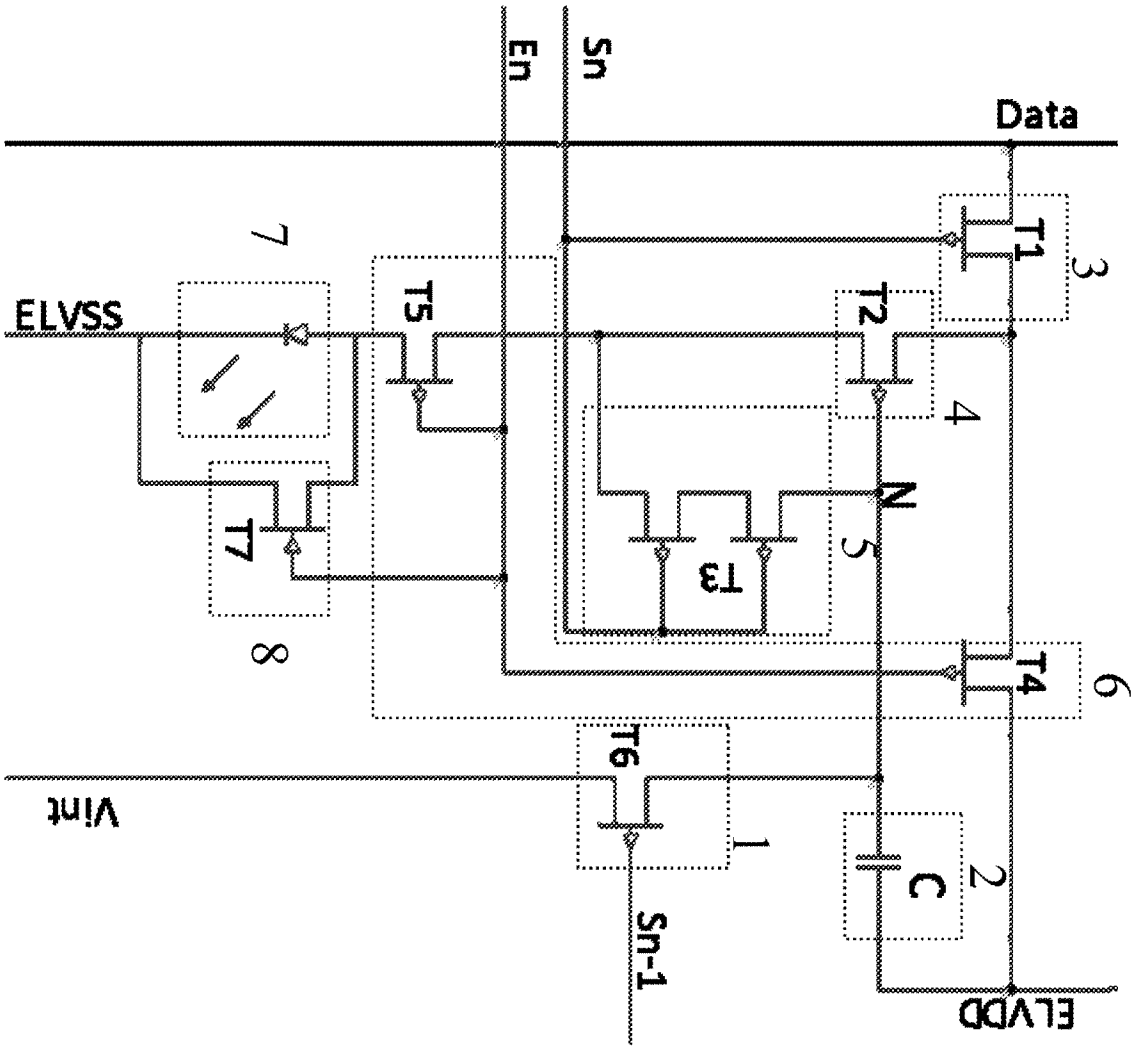
FIG. 4 is a circuit diagram of a pixel circuit according to another embodiment of the present disclosure.

FIG. 4 is a circuit diagram of a pixel circuit according to another embodiment of the present disclosure. As shown in FIG. 4, on the basis of the embodiment shown in FIG. 3, a shunt module 8 is added. The shunt module 8 is connected between the first and second electrodes of the organic light emitting diode OLED. The shunt module 8 may include a seventh transistor T7. The control electrode of the seventh transistor T7 is connected to the first scan line En, the first electrode of the seventh transistor T7 is connected to the first electrode of the organic light emitting diode OLED, and the second electrode of the seventh transistor T7 is connected to the second electrode of the organic light emitting diode OLED. The seventh transistor T7 can eliminate the current (including the leakage current) passing through the organic light emitting diode OLED before the organic light emitting diode OLED emits light, and assure the correctness of the state of the organic light emitting diode OLED.

Hereinafter, the operation timing of the embodiment of the present disclosure will be described. Although with respect to the circuit in FIG. 3, the circuit in FIG. 4 is provided with a shunt module 8, but the operation timings of the embodiments shown in FIG. 3 and FIG. 4 are the same, so that only the operation timing of the embodiment shown in FIG. 4 is described below. In order to more conveniently describe the relationship between the level of the scan line and the turn-on of each transistor, the description will be given by example of the first transistor T1 to the sixth transistor T6 being P-type MOS transistors and the seventh transistor T7 being the N-type MOS transistor. For a P-type MOS transistor, the first electrode may refer to the source and the second electrode may refer to the drain. For an N-type MOS transistor, the first electrode may refer to the drain, and the second electrode may refer to the source. It is to be noted that the description of the above-mentioned transistor type and the description of the valid level on the scan line below are not limitations of the present disclosure and those skilled in the art may select the type of transistor and the valid level according to practical circuit requirements.

Figure 5:
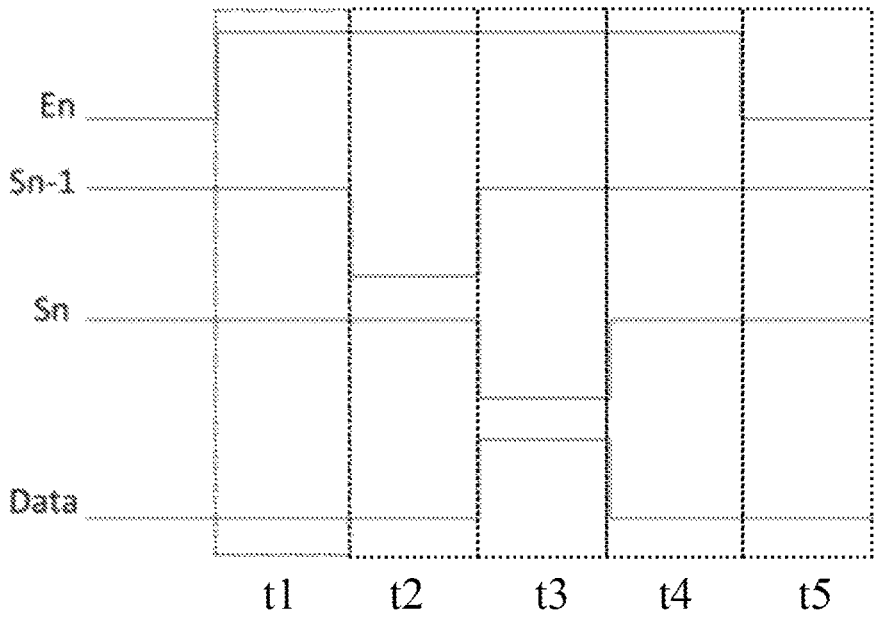
FIG. 5 is a diagram of the operation timing of the pixel circuit of the embodiment shown in FIG. 4.

FIG. 5 is a diagram of the operation timing of the pixel circuit of the embodiment shown in FIG. 4. As shown in FIG. 5, the operation timing of the pixel circuit of this embodiment includes five phases, namely, the first phase t1, the second phase t2, the third phase t3, the fourth phase t4, and the fifth phase t5. The first scan line En, the second scan line Sn-1, the third scan line Sn, and the data line Data provide signals to the circuit in each phase. The operation process of the pixel circuit according to the present embodiment will be described in detail below in conjunction with the operation timing shown in FIG. 5 and the current flowing direction and the transistor state shown in FIGS. 6 through 10.

Figure 6:
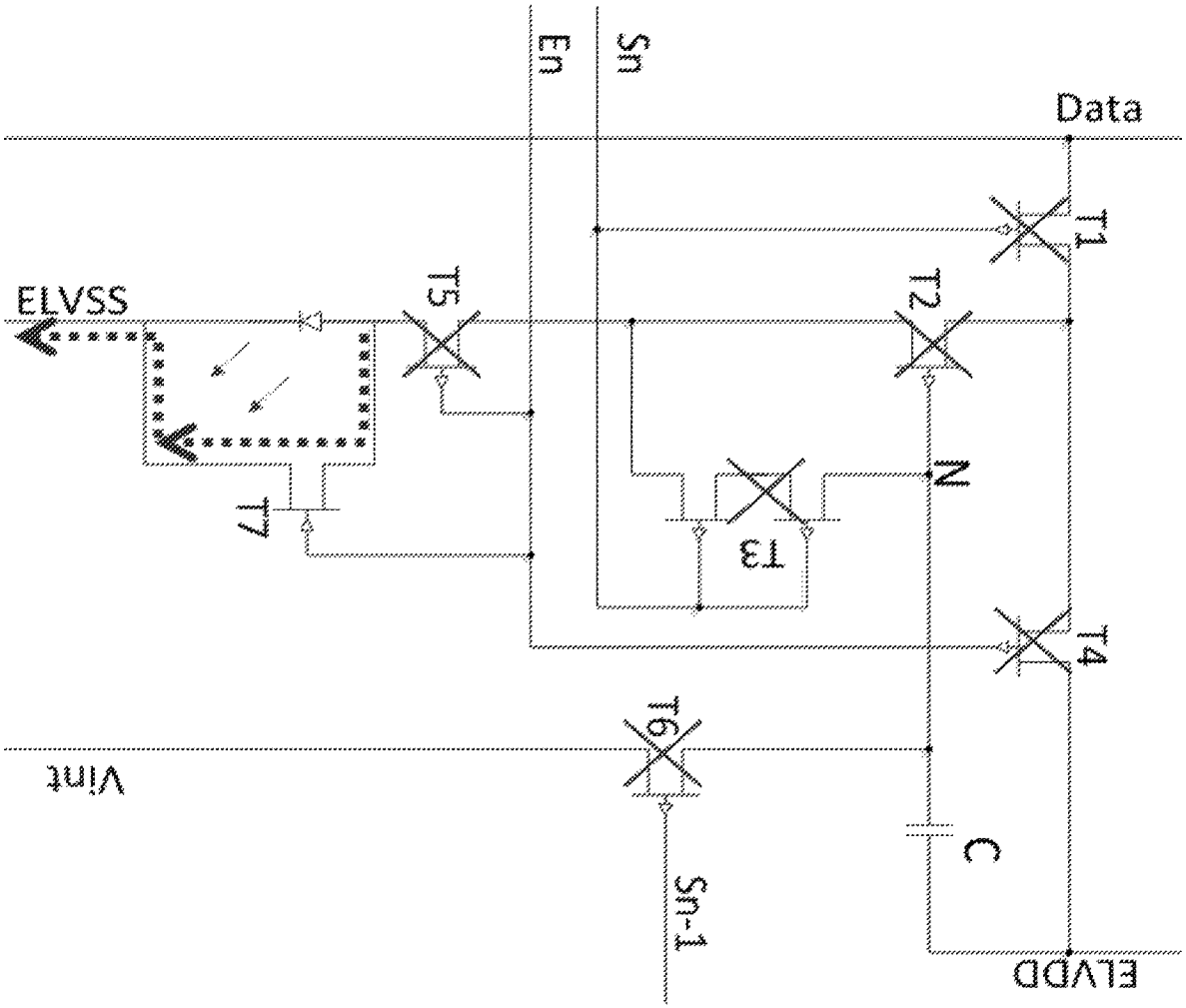
FIG. 6 is a schematic diagram of the state of the pixel circuit of the embodiment of FIG. 4 in the first phase.

FIG. 6 is a schematic diagram of the state of the pixel circuit of the embodiment of FIG. 4 in the first phase, in which the current flowing direction and the transistor state are shown. In the first phase t1, the organic light emitting diode OLED is initialized to prevent the light emission caused by periodic abnormal potential. As shown in FIG. 5, the voltages of the first scan line En, the second scan line Sn-1, and the third scan line Sn are at high levels and the voltage of the data line Data is at a low level (the voltage of the data line Data is at a low level indicating that no data signal is transmitted). In this case, the reset module 1, the storage module 2, the data write module 3, the drive module 4, the control voltage compensation module 5, the light emission control module 6, and the light emitting module 7 do not operate. The shunt module 8 operates to shunt the current flowing through the organic light emitting diode OLED.

Specifically, as shown in FIG. 6, the first transistor T1, the second transistor T2, the third transistor T3, the fourth transistor T4, the fifth transistor T5, and the sixth transistor T6 are turned off so that there is no voltage difference across two ends of the organic light emitting diode OLED, in a state without the current flowing, eliminating the light emitting phenomenon. In the present embodiment, the seventh transistor T7 is turned on to connect the first and second electrodes of the organic light emitting diode OLED to further prevent the leakage current that may still be present when the transistor is turned off in the circuit from flowing through the organic light emitting diode OLED.

As described above, the type of the level on the scan line is determined here depending on the type of transistor. In order to turn off the first transistor T1 to the sixth transistor T6, and turned on the seventh transistor T7, a high voltage is provided on the scan line. It will be appreciated by those skilled in the art that if the transistor type changes, the corresponding level type also changes accordingly.

Figure 7:
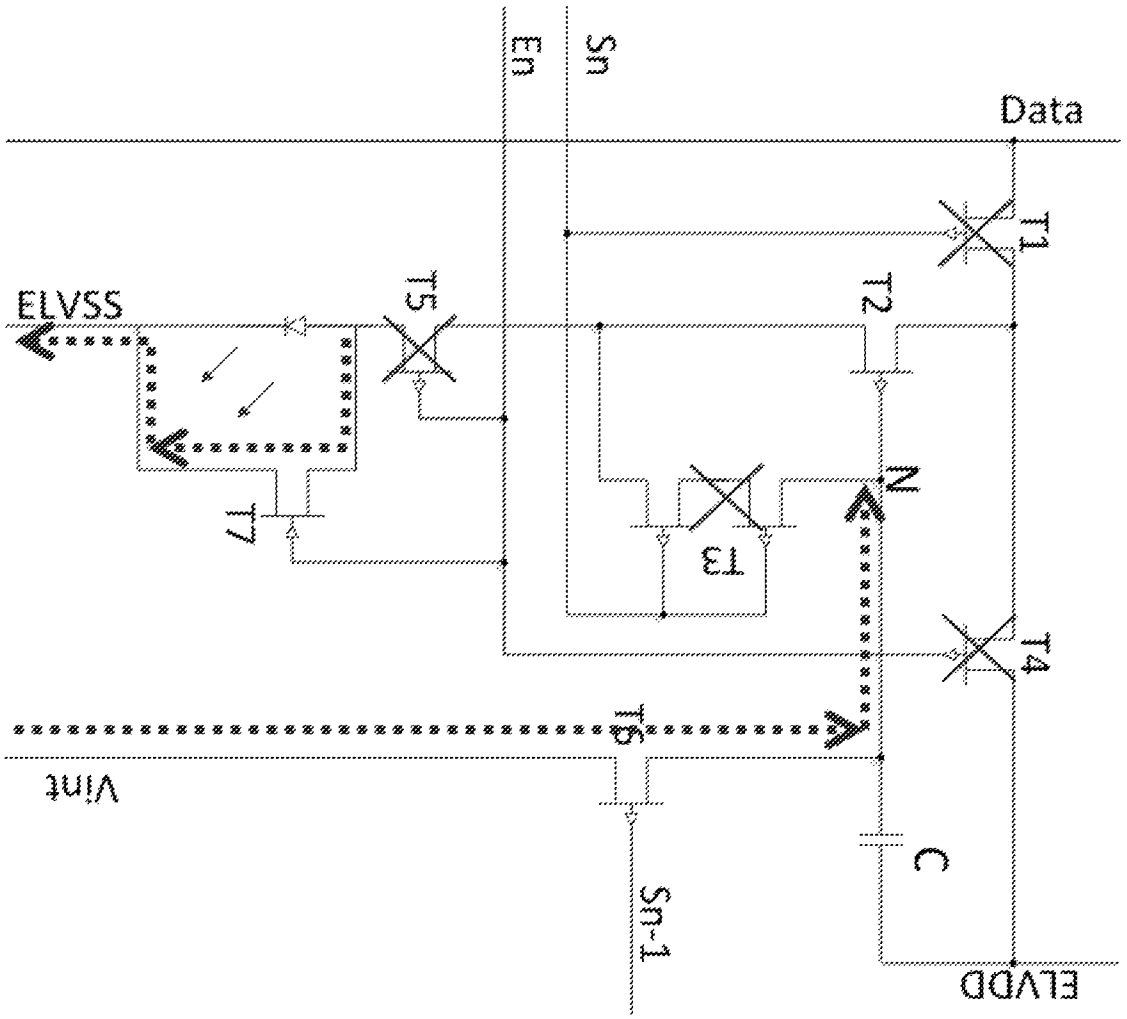
FIG. 7 is a schematic diagram of the state of the pixel circuit of the embodiment of FIG. 4 in the second phase.

FIG. 7 is a schematic diagram of the state of the pixel circuit of the embodiment of FIG. 4 in the second phase t2, showing the current flowing direction and the transistor state. In the second phase t2, the voltage stored in the storage module 2 is reset to prepare for storing the voltage indicative of the data signal transmitted by the data line Data. As shown in FIG. 5, the voltage of the first scan line En is at a high level, the voltage of the second scan line Sn-1 is at a low level, the voltage of the third scan line Sn is at a high level, and the voltage of the data line Data is at a low level. In this case, the data write module 3, the drive module 4, the control voltage compensation module 5, the light emission control module 6, and the light emitting module 7 do not operate. The shunt module 8 is still operating. The reset module 1 and the storage module 2 operate to reset the voltage stored in the storage module 2 to the voltage Vvint of the third power source Vint (Vvint: the voltage of the third power source Vint).

Specifically, as shown in FIG. 7, the first transistor T1 is turned off, the second transistor T2 is turned on, the third transistor T3 is turned off, the fourth transistor T4 is turned off, the fifth transistor T5 is turned off, the sixth transistor T6 is turned on and the seventh transistor T7 is turned on. In the figure, the voltage at the current collecting point N (i.e., the connection point between the second electrode of the capacitor C and the control electrode of the second transistor T2) is reset to the voltage of the third power source Vint, i.e., the voltage of the control electrode of the second transistor T2 Vg=Vvint.

Figure 8:
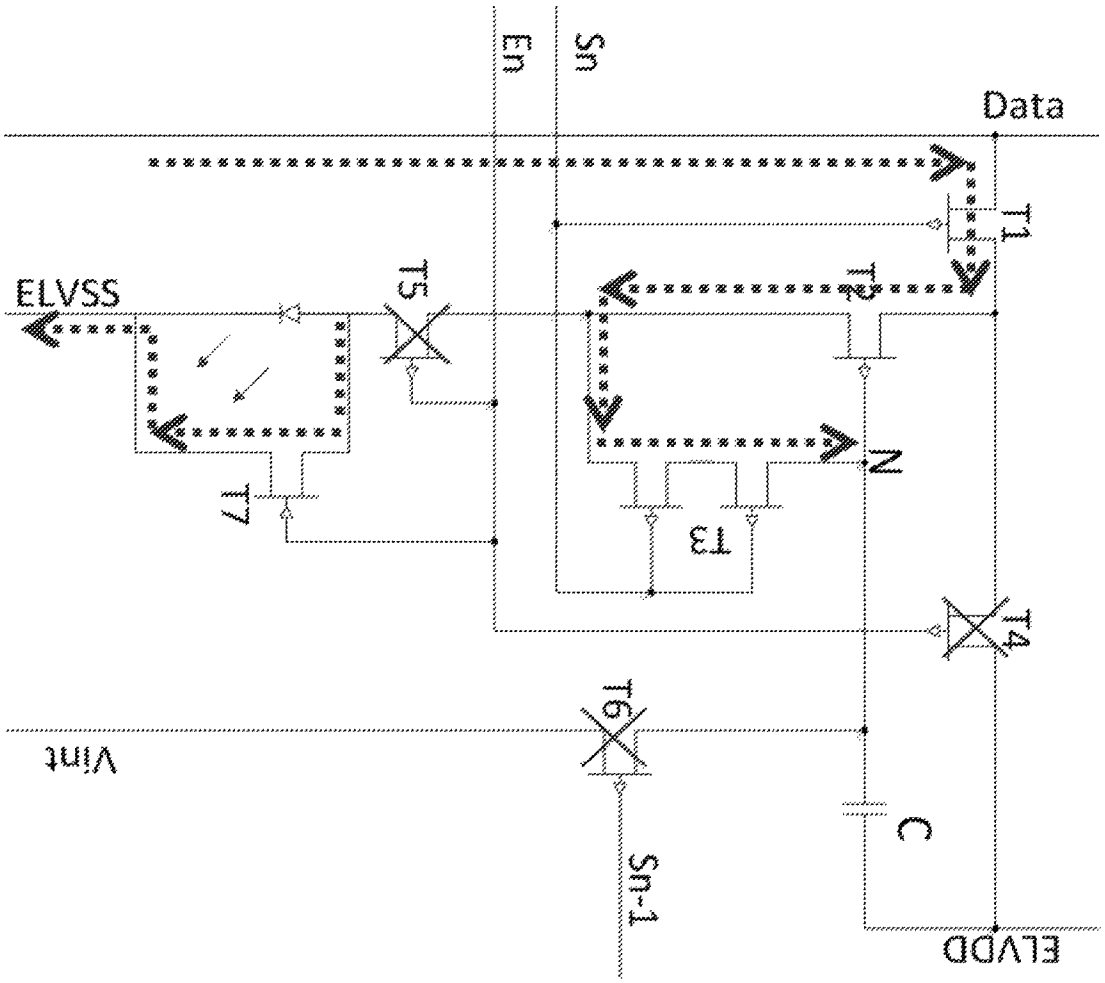
FIG. 8 is a schematic diagram of the state of the pixel circuit of the embodiment of FIG. 4 in the third phase.

FIG. 8 is a schematic diagram of the state of the pixel circuit of the embodiment of FIG. 4 in the third phase t3, showing the current flowing direction and the transistor state. In the third phase t3, the storage module 2 stores a voltage corresponding to the display data. As shown in FIG. 5, the voltage of the first scan line En is at a high level, the voltage of the second scan line Sn-1 is at a high level, the voltage of the third scan line Sn is at a low level, and the voltage of the data line Data is at a high level. In this case, the reset module 1, the light emission control module 6, and the organic light emitting diode OLED do not operate. The shunt module 8 is still operating. The data write module 3 supplies the voltage from the data line Data corresponding to the display content of the pixel circuit to the storage module 2 via the drive module 4 and the control voltage compensation module 5. The control voltage compensation module 5 compensates the voltage supplied by the data write module 3 to obtain the control voltage for the drive module 4 stored in the storage module 2.

Specifically, as shown in FIG. 8, the first transistor T1 is turned on, the second transistor T2 is turned on, the third transistor T3 is turned on, the fourth transistor T4 is turned off, the fifth transistor T5 is turned off, the sixth transistor T6 is turned off, and the seven transistor T7 is turned on. Since the third transistor T3 is turned on, the second electrode and the control electrode of the second transistor T2 are shorted to constitute a structure similar to a diode. The voltage at the current collecting point N changes to Vvdata+Vth (Vvdata: voltage transmitted by the data line, Vth: the threshold voltage of the second transistor T2). Here, the threshold voltage Vth to turn on the second transistor T2 is the threshold value of the voltage Vgs between the gate and the source.

Figure 9:
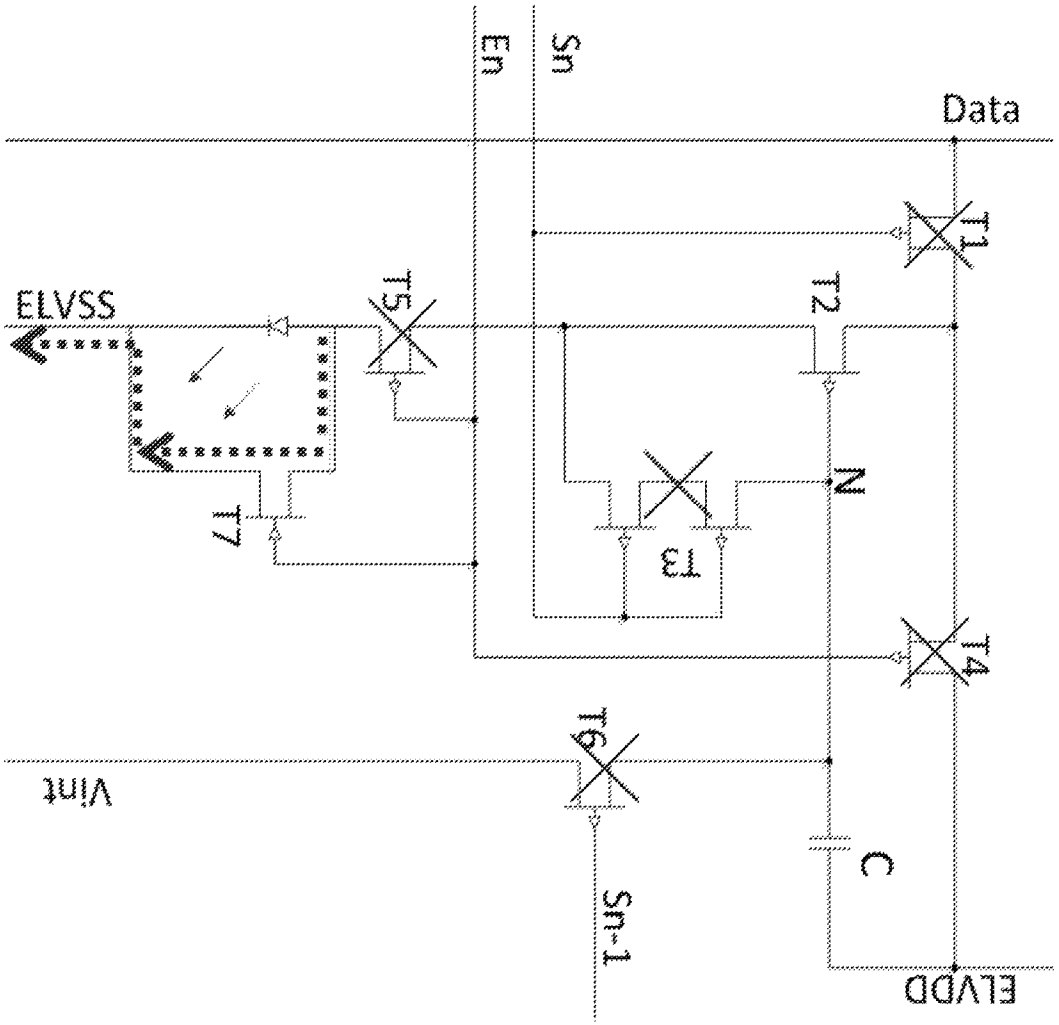
FIG. 9 is a schematic diagram of the state of the pixel circuit of the embodiment of FIG. 4 in the fourth phase.

FIG. 9 is a schematic diagram of the state of the pixel circuit of the embodiment of FIG. 4 in the fourth phase t4, showing the current flowing direction and the transistor state. In the fourth phase t4, the organic light emitting diode OLED is initialized again to prevent the light emission caused by periodic abnormal potential. The specific procedure is the same as the first step. The initiation is performed again before the organic light emitting diode OLED emits light, thereby ensuring that in the light emitting phase, the organic light emitting diode OLED emits light accurately according to the display data signal to ensure the accuracy of the display.

Figure 10:
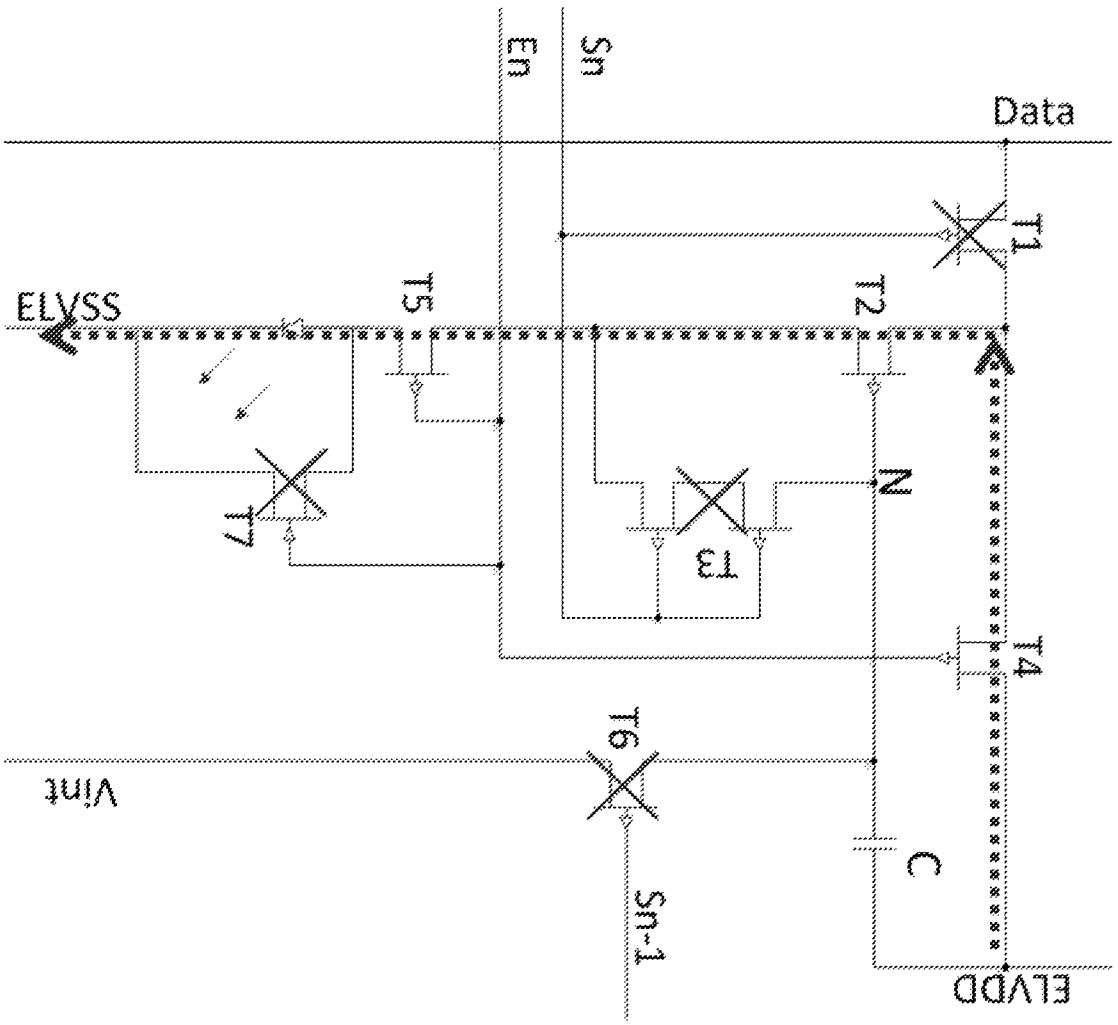
FIG. 10 is a schematic diagram of the state of the pixel circuit of the embodiment of FIG. 4 in the fifth phase.

FIG. 10 is a schematic diagram of the state of the pixel circuit of the embodiment of FIG. 4 in the fifth phase t5, showing the current flowing direction and the transistor state. In the fifth phase t5, the organic light emitting diode OLED emits light, and realizes the accurate display of the display data. As shown in FIG. 5, the voltage of the first scan line En is at a low level, the voltage of the second scan line Sn-1 is at a high level, the voltage of the third scan line Sn is at a high level, and the voltage of the data line Data is at a low level. In this case, the reset module 1, the data write module 3, the control voltage compensation module 5, and the shunt module 8 do not operate. The storage module 2, the drive module 4, the light emission control module 6, and the organic light emitting diode OLED operate. The drive module 4 drives the light emitting module 7 to emit light according to the voltage stored in the storage module 2.

Specifically, as shown in FIG. 10, the first transistor T1 is turned off, the second transistor T2 is turned on, the third transistor T3 is turned off, the fourth transistor T4 is turned on, the fifth transistor T5 is turned on, the sixth transistor T6 is turned off, and the seventh transistors T7 is turned off. The voltage of the control electrode of the second transistor T2 is Vg=Vvdata+Vth, and the voltage of the first electrode of the second transistor T2 is Vt21=Velvdd (Velvdd: the voltage of the first power source ELVDD). Therefore, the voltage between the control electrode and the first electrode of the second transistor T2 is Vgs=Vvdata+Vth-Velvdd.

According to the saturated current formula, the current flowing through the organic light emitting diode OLED is:

$$\begin{aligned} Ioled &= K(Vgs - Vth)^2 \\ &= K(Vvdata + Vth - Velvdd - Vth)^2 \\ &= K(Vvdata - Velvdd)^2 \end{aligned}$$

Where, $$K = \mu C_{ox} \frac{W}{L},$$

μ and $C_{ox}$ are process constants, W is the channel width of the second transistor T2, L is the channel length of the second transistor T2, and W and L are both constants that can be selectively designed, so that K is a constant that can be determined in advance. From the above formula, it can be seen that the current Ioled flowing through the organic light emitting diode OLED is not affected by the threshold voltage Vth of the second transistor T2, but is only related to the voltage Vvdata transmitted by the data line and the voltage Velvdd of the first power source ELVDD. The pixel circuit thus can output a stable drive current without being affected by the threshold voltage Vth of the second transistor T2.

Since in the third phase t3 and the fifth phase t5, the current flows through the second transistor T2 in the same direction, it can be ensured that the organic light emitting diode OLED emits light accurately according to the data signal at the light emitting phase, and the accuracy of the display is ensured. In addition, the seventh transistor T7 is turned off, and the efficiency and characteristics of the organic light emitting diode OLED can be ensured.

The five phases abovementioned constitute a complete light emission control cycle, and after the completion of the fifth phase t5, it may proceed to a next light emission control cycle, to start a new first phase t1.

The pixel circuits in the embodiments of the present disclosure are arranged in a matrix form for use in a display panel. The display panel may be used for a display device. The display device may specifically be any product or component having display function, such as a liquid crystal display, an LCD TV, an OLED display, an OLED television, an electronic paper, a mobile phone, a tablet computer, and a digital photo frame.

Furthermore, although the description is made by example of the light emitting diode OLED, this is not a limitation of the present disclosure. The light emitting module 7 in the embodiment of the present disclosure may be another kind of light emitting element or display element.

It is to be understood that the above embodiments are merely exemplary embodiments employed for the purpose of illustrating the principles of the present disclosure, but the disclosure is not limited thereto. It will be apparent to those skilled in the art that various modifications and improvements can be made without departing from the spirit and essence of the present disclosure, and they are considered to be within the scope of the present disclosure.

What is claimed is:

1. A pixel circuit comprising:

a reset circuit;

a storage circuit;

a data write circuit;

a drive circuit;

a control voltage compensation circuit;

a light emission control circuit;

a light emitting circuit, wherein the reset circuit is connected to a third power source, a second scan line, and the storage circuit, and is configured to reset the voltage stored in the storage circuit, wherein the storage circuit is connected to a first power source and configured to store a control voltage for the drive circuit, wherein the data write circuit is connected to a data line and a third scan line, and is configured to provide a voltage required for a display of the pixel circuit to the drive circuit, wherein the drive circuit is connected to the storage circuit, and is configured to drive the light emitting circuit to emit light via the light emission control circuit based on the control voltage stored in the storage circuit, wherein the control voltage compensation circuit is connected to the third scan line and the drive circuit, and is configured to compensate the voltage provided by the data write circuit to obtain the control voltage for the drive circuit, wherein the light emission control circuit comprises a fourth transistor and a fifth transistor that are both directly connected to a first scan line and that are electrically connected to the first power source, and is configured to control the provision of a voltage of the first power source to the drive circuit and control the driving of the drive circuit to the light emitting circuit, and wherein the light emitting circuit is configured to emit light under the driving of the drive circuit; and a shunt circuit connected in parallel to the light emitting circuit, wherein the shunt circuit is configured to shunt the current flowing through the light emitting circuit, wherein the shunt circuit comprises a seventh transistor, wherein a first electrode and a second electrode of the seventh transistor are directly connected to the light emitting circuit, and wherein a control electrode of the seventh transistor is directly connected to the first scan line.

2. The pixel circuit according to claim 1, wherein the drive circuit comprises:

a control electrode;

a first electrode; and a second electrode, wherein the control electrode of the drive circuit is connected to the storage circuit, wherein the first electrode of the drive circuit is connected to the data write circuit and connected to the first power source via the light emission control circuit, wherein the second electrode of the drive circuit is connected to the light emitting circuit via the light emission control circuit, and wherein the control voltage compensation circuit is connected to the control electrode and second electrode of the drive circuit.

3. The pixel circuit according to claim 2, wherein the drive circuit comprises a second transistor, and wherein a control electrode, a first electrode, and a second electrode of the second transistor are connected to the control electrode, the first electrode, and the second electrode of the drive circuit, respectively.

4. The pixel circuit according to claim 1, wherein the reset circuit, the data write circuit, the control voltage compensation circuit, and the light emission control circuit are implemented with transistors, and wherein, in the pixel circuit, the seventh transistor is an N-type MOS transistor, and the remaining transistors are P-type MOS transistors.

5. A method for driving the pixel circuit according to claim 1, comprising;

a first phase initializing the light emitting circuit;

a second phase resetting a voltage stored in the storage circuit to be the voltage of the third power source;

a third phase storing a control voltage for the drive circuit in the storage circuit;

a fourth phase resetting the light emitting circuit; and a fifth phase driving the light emitting circuit to emit light by the drive circuit based on the voltage stored in the storage circuit.

6. The method according to claim 5, wherein the pixel circuit further comprises a shunt circuit, wherein the shunt circuit is connected in parallel to the light emitting circuit and is configured to shunt the current flowing through the light emitting circuit, and wherein, in the first through fourth phases, the shunt circuit shunts the current flowing through the light emitting circuit.

7. The method according to claim 6, wherein the shunt circuit comprises a seventh transistor, wherein a first electrode and a second electrode of the seventh transistor are connected to the light emitting circuit, wherein, in the first through fourth phases, the seventh transistor is turned on, and wherein, in the fifth phase, the seventh transistor is turned off.

8. The method according to claim 7, wherein the drive circuit, the reset circuit, the data write circuit, the control voltage compensation circuit, and the light emission control circuit are implemented with transistors, wherein, in the first phase, the data write circuit is turned off, a driver circuit is turned off, the control voltage compensation circuit is turned off, the light emission control circuit is turned off, and the reset circuit is turned off, wherein, in the second phase, the data write circuit is turned off, the drive circuit is turned on, the control voltage compensation circuit is turned off, the light emission control circuit is turned off, and the reset circuit is turned on, wherein, in the third phase, the data write circuit is turned on, the drive circuit is turned on, the control voltage compensation circuit is turned on, the light emission control circuit is turned off, and the reset circuit is turned off, wherein, in the fourth phase, the data write circuit is turned off, the drive circuit is turned off, the control voltage compensation circuit is turned off, the light emission control circuit is turned off, and the reset circuit is turned off, and wherein, in the fifth phase, the data write circuit is turned off, the drive circuit is turned on, the control voltage compensation circuit is turned off, the light emission control circuit is turned on, and the reset circuit is turned off.

9. The method according to claim 8, wherein, in the pixel circuit, the seventh transistor is an N-type MOS transistor and the remaining transistors are P-type MOS transistors, wherein, in the first phase, a high level voltage is provided on the first scan line, a high level voltage is provided on the second scan line, a high level voltage is provided on the third scan line, and a low level voltage is provided on the data line, wherein, in the second phase, a high level voltage is provided on the first scan line, a low level voltage is provided on the second scan line, a high level voltage is provided on the third scan line, and a low level voltage is provided on the data line, wherein, in the third phase, a high level voltage is provided on the first scan line, a high level voltage is provided on the second scan line, a low level voltage is provided on the third scan line, and a high level voltage is provided on the data line, wherein, in the fourth phase, a high level voltage is provided on the first scan line, a high level voltage is provided on the second scan line, a high level voltage is provided on the third scan line, and a low level voltage is provided on the data line, and wherein, in the fifth phase, a low level voltage is provided on the first scan line, a high level voltage is provided on the second scan line, a high level voltage is provided on the third scan line, and a low level voltage is provided on the data line.

10. A display panel comprising the pixel circuit according to claim 1.

11. A display device comprising the display panel according to claim 10.

12. The display panel according to claim 10, wherein the drive circuit comprises a control electrode, a first electrode, and a second electrode, wherein the control electrode of the drive circuit is connected to the storage circuit, wherein the first electrode of the drive circuit is connected to the data write circuit and connected to the first power source via the light emission control circuit, wherein the second electrode of the drive circuit is connected to the light emitting circuit via the light emission control circuit, and wherein the control voltage compensation circuit is connected to the control electrode and second electrode of the drive circuit.

13. The display panel according to claim 12, wherein the drive circuit comprises a second transistor, and wherein a control electrode, a first electrode, and a second electrode of the second transistor are connected to the control electrode, the first electrode, and the second electrode of the drive circuit, respectively.

14. The display panel according to claim 10, wherein the reset circuit, the data write circuit, the control voltage compensation circuit, and the light emission control circuit are implemented with transistors, and wherein, in the pixel circuit, the seventh transistor is an N-type MOS transistor, and the remaining transistors are P-type MOS transistors.

* * * * *